US006276063B1

(12) United States Patent
Chen

(10) Patent No.: US 6,276,063 B1
(45) Date of Patent: Aug. 21, 2001

(54) FOLDING KNIFE WITH SAFETY FOR BLADE

(75) Inventor: Shun-fu Chen, Taipei Hsien (TW)

(73) Assignee: Chia Yi Ent. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/512,067

(22) Filed: Feb. 24, 2000

(51) Int. Cl.[7] ..... B26B 1/04
(52) U.S. Cl. ..... 30/161; 30/155; 30/342
(58) Field of Search ..... 30/161, 160, 155, 30/153, 158, 159, 342

(56) References Cited

U.S. PATENT DOCUMENTS 4,451,982 * 6/1984 Collins ..... 30/161
4,586,256 * 5/1986 Weimann ..... 30/162
4,811,486 * 3/1989 Cunningham ..... 30/161
5,596,808 1/1997 Lake et al. .
5,699,615 * 12/1997 Chen ..... 30/160
5,822,866 * 10/1998 Pardue ..... 30/161
5,839,194 * 11/1998 Bezold ..... 30/161
5,875,552 * 3/1999 Chen ..... 30/161
5,964,036 * 10/1999 Centofante ..... 30/161
6,101,723 * 8/2000 Ford ..... 30/157
6,122,829 * 9/2000 McHenry ..... 30/161
6,145,202 * 11/2000 Onion ..... 30/160

* cited by examiner

*Primary Examiner*—Rinaldi I. Rada
*Assistant Examiner*—Kim Ngoc Tran
(74) *Attorney, Agent, or Firm*—Rabin & Champagne, P.C.

(57) ABSTRACT

A folding knife with a safety for blade is provided. When a blade of the folding knife has been turned to an extended position, a slip switch of the safety for blade is moved to a safety lock position to depress a push element, so that the push element engages a lower end with a first locking hole on the blade, preventing the blade from undesirably closing in the event a blade lock of the folding knife is unexpectedly released or the blade is subject to an over big impact. On the other hand, when the blade has been turned to a folded position in a handle of the knife and the slip switch is moved to the safety lock position, the push element engages its lower end with a second locking hole on the blade to prevent the blade from undesirably separating from the handle. The safety for blade therefore provides the folding knife with a further means to ensure the safe use of the folding knife.

9 Claims, 4 Drawing Sheets

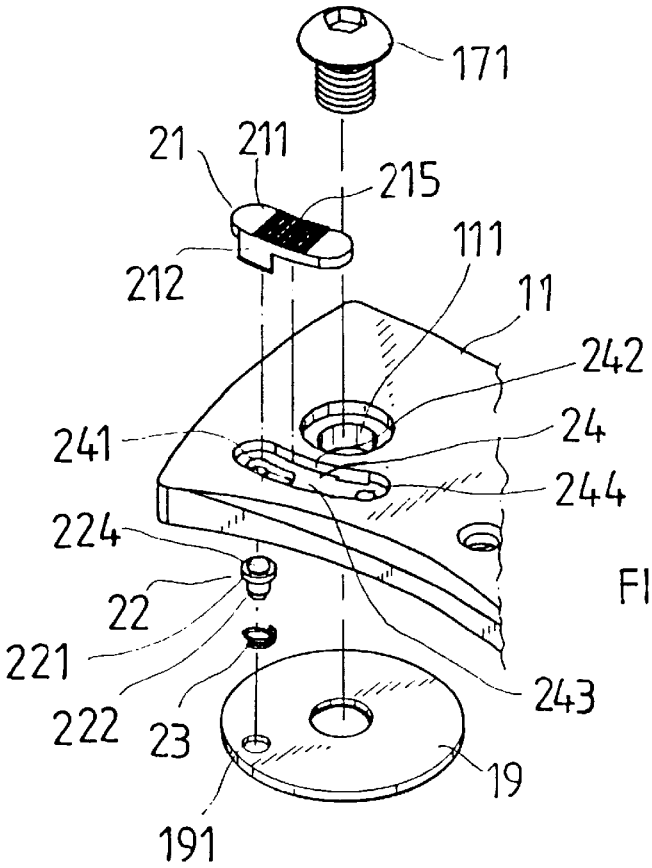
FIG. 4
FIG. 5
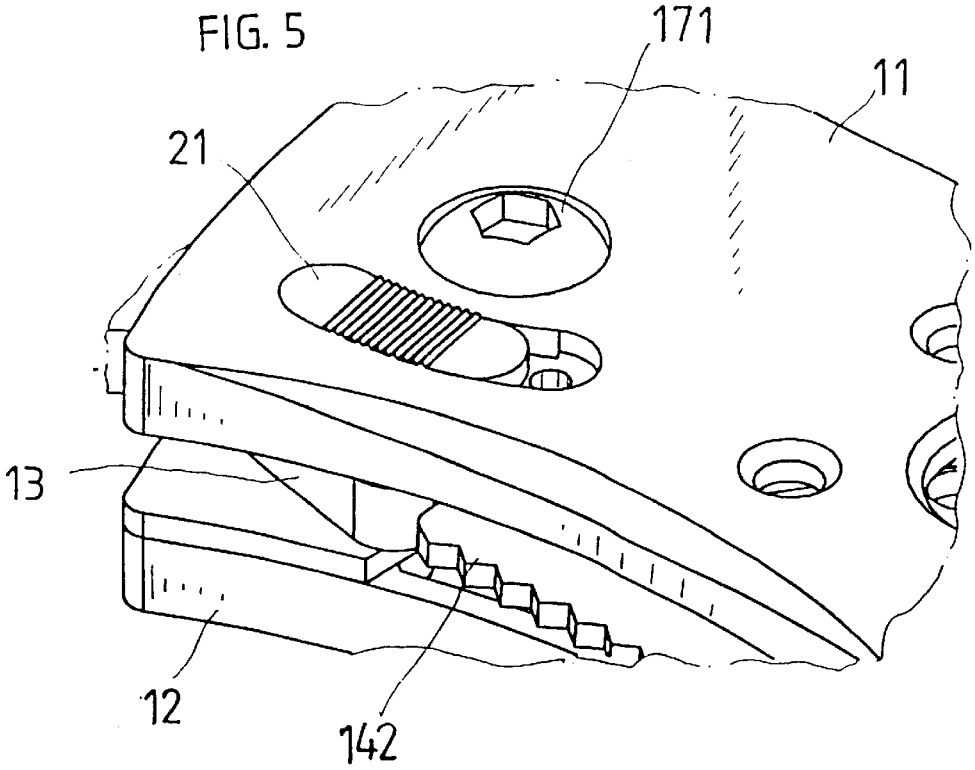

FIG. 6
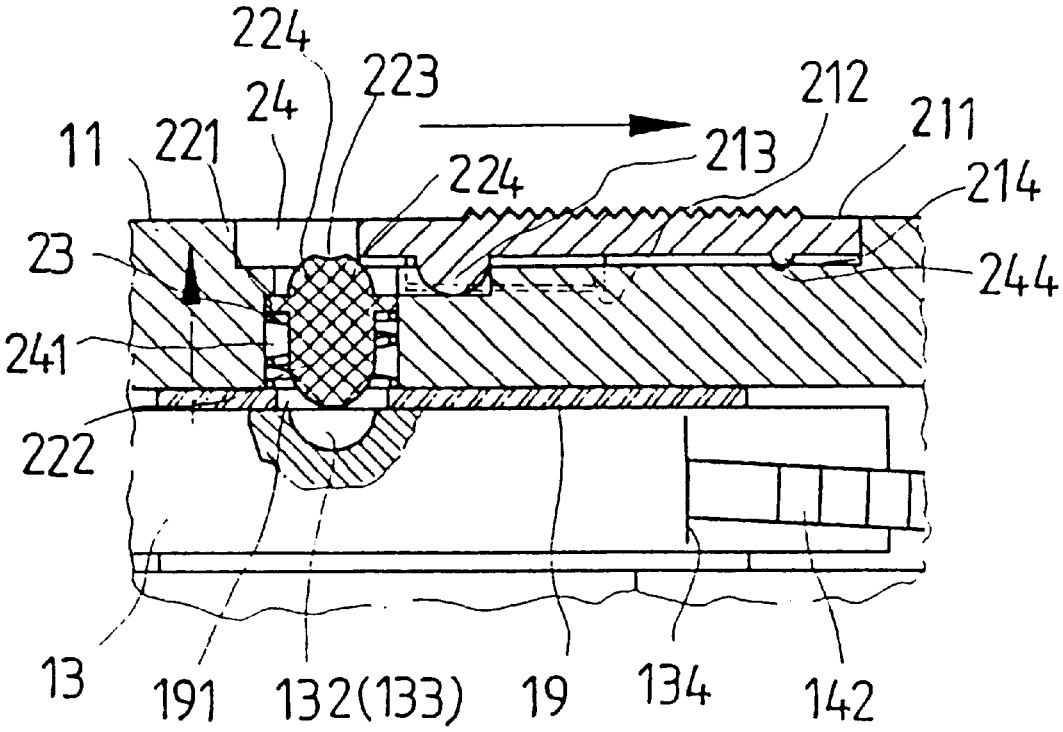
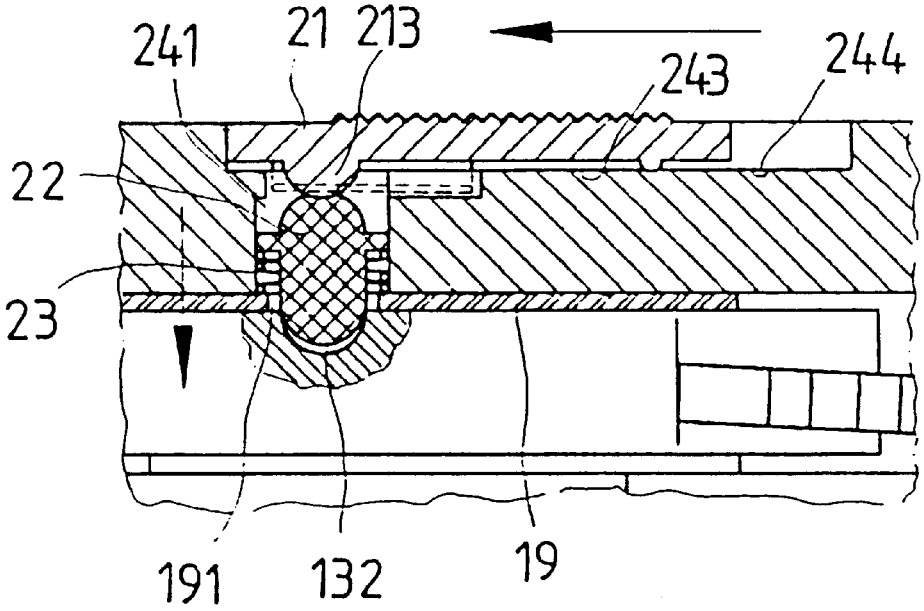
FIG. 7

FOLDING KNIFE WITH SAFETY FOR BLADE

BACKGROUND OF THE INVENTION

1. Field of the Invention

The present invention relates to a folding knife with safety for blade, and more particularly to a folding knife with a safety for blade mounted on a handle of the knife, so that the safety for blade can be conveniently operated with only one finger to lock the blade in place after the blade has been extended from the handle or folded into the handle.

2. Description of Prior Art

Generally, a knife with one or more folding blades employs an inclined leaf spring as a,blade lock. When a knife blade is rotated into a fully open position, the leaf spring presses against a rear end surface of the blade to prevent the blade from moving. To close the blade, the leaf spring is depressed so that it no longer presses against the rear end of the blade and thereby allows the blade to rotate into a folded position in the knife handle.

When a user uses a pointed front end of such folding blade on a knife to, for example, cut a hole on something, and the blade is subject to a large vertical force or large recoil, it is very possible the leaf spring disengages from the blade due to an overly large force applied on it, resulting in an unexpectedly closed blade to injure the user.

U.S. Pat. No. 5,596,808 entitled "Safety for Blade Lock" discloses a knife having a folding blade, a blade lock in the form of a leaf spring, and a safety for preventing unlocking of the lock. The safety has an elongate arm mounted on the knife handle. A stud is positioned on an inside surface of one end of the arm. A contact surface is formed on an outside surface of the arm opposite from the stud. The other end of the arm is pivotably attached to the handle of the knife. The arm may be swung from a release position, unobstructive of the lock, to a safety position in which the presence of the stud prevents unlocking the lock. And, the arm may be spring biased toward the release position allowing a user to move the blade into a folded position in the handle.

The safety for blade lock disclosed in U.S. Pat. No. 5,596,808, either in the form of an elongate arm, a slide or a rotating disk, requires the stud to press against a lateral side of the blade lock. In the event there is any defect in the structural design of the folding knife, or the blade of the folding knife is not sufficiently pivotally tightened to the handle, or a clearance between the blade lock and the stud increases due to wearing after the folding knife has been used for a long time, the blade lock tends to lose its safety effect.

Moreover, either the folding knife disclosed in U.S. Pat. No. 5,596,808 or other general folding knives do not have any other safety designed to prevent possible separation of a blade in the folded position from the handle due to serious vibration or dropping from a high position. Therefore, it is desirable to develop a safety for blade that can be easily operated to safely hold an extended or folded blade in place.

SUMMARY OF THE INVENTION

It is a primary object of the present invention to provide a folding knife with a safety for blade, wherein when the blade of the folding knife is turned into an extended position for use, the safety for blade may be moved to a lock position to safely hold the blade in the extended position without the risk of an unexpectedly closed blade due to an over large force applied on the blade; and on the other hand, when the blade is turned into a folded position in the handle for storage, the safety for blade in the lock position ensures the blade is safely held in the folded position without the risk of unexpectedly separating from the handle.

Another object of the present invention is to provide a folding knife with a safety for blade, wherein the safety for blade is provided on the handle of the folding knife close to a pivot pin thereof and could be conveniently operated with only one finger to lock or unlock the blade either in extended or folded position.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein

FIG. 4 is a fragmentary, enlarged, and partially exploded perspective of the folding knife of FIG. 1 showing the safety for blade thereof;

FIG. 5 is an enlarged and assembled perspective view of FIG. 4;

FIG. 6 shows the safety for blade of the present invention is moved to a safety unlock position; and FIG. 7 shows the safety for blade of the present invention is moved to a safety lock position.

DETAILED DESCRIPTION OF THE PREFERRED EMBODIMENTS

Figure 1:
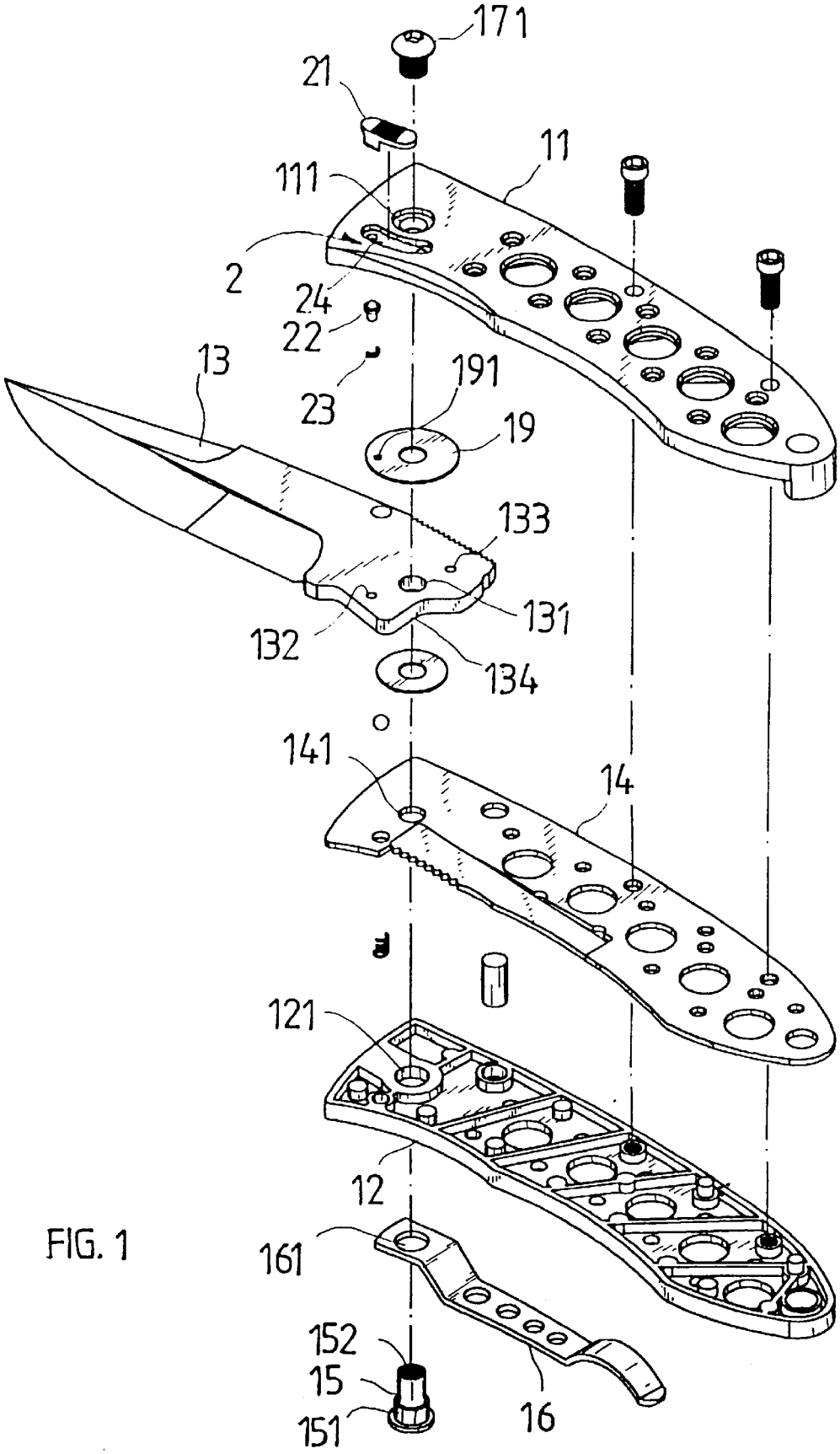
FIG. 1 is an exploded perspective of a folding knife with safety for blade according to the present invention.
Figure 3:
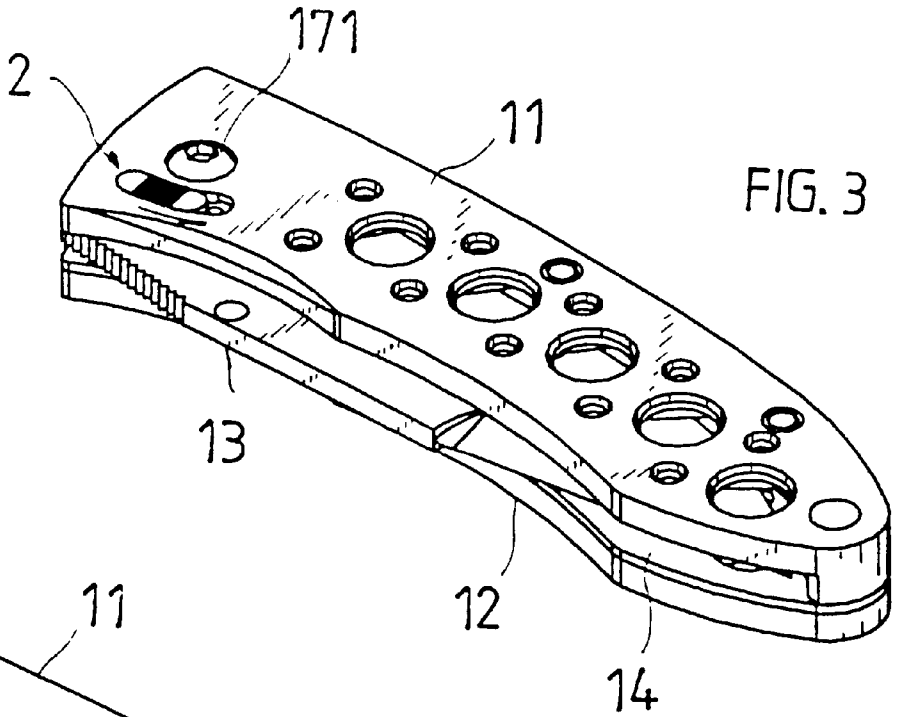
FIG. 3 is an assembled perspective of the folding knife of FIG. 1 with the blade thereof in a folded position.
Figure 2:
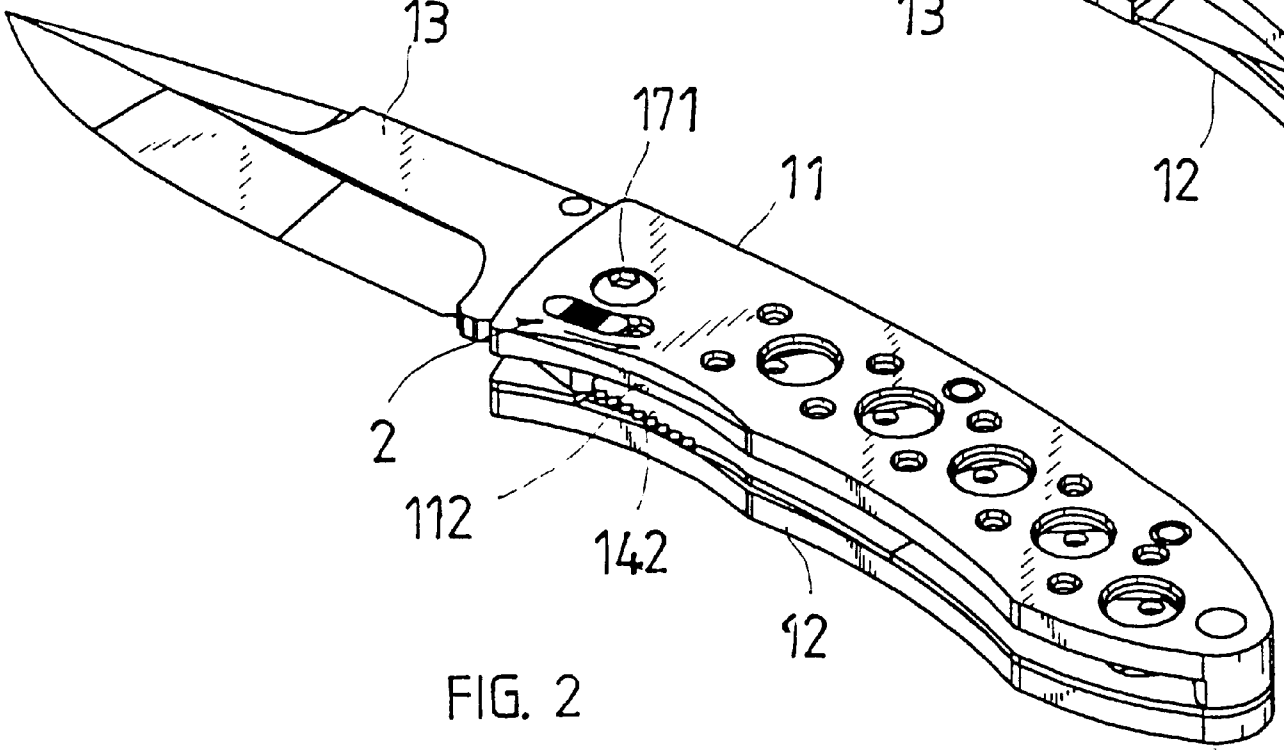
FIG. 2 is an assembled perspective of the folding knife of FIG. 1 with the blade thereof in an extended position.

Please refer to FIGS. 1, 2 and 3 in which a folding knife is illustrated as an example based on which the following description is made. The folding knife mainly includes a handle composed of a first and a second handle cover 11 and 12, a blade 13 located between the first and the second handle covers 11 and 12, a blade lock 14 located between the blade 13 and an inner side of the second handle cover 12, a pivot pin 15, and a clip 16 attached to an outer surface of the second handle cover 12. The pivot pin 15 includes a substantially D-shaped seat 151 and is extended through a D-shaped hole 161 correspondingly formed at one end of the clip 16, and through holes 121, 141, 131 and 111 sequentially formed on the second handle cover 12, the blade lock 14, the blade 13 and the first handle cover 11. A bolt 171 is screwed into an internally threaded top hole 152 of the pivot pin 15 to bind the above components together with the blade 13 being rotatable about the pivot pin 15 relative to the handle into an extended position for use as shown in FIG. 2 or a folded position for storage between the first and the second handle covers 11, 12 as shown in FIG. 3. The blade lock 14 includes a main body 14 and a leaf spring 142 that is connected at an end to the main body 14 with a free end thereof normally inclines toward the blade 13. When the blade 13 is in the extended position as shown in FIG. 2, the free end of the leaf spring 142 would just press against a rear end surface 134 of the blade 13 to lock the blade 13 in the extended position. To rotate the blade 13 into the folded position as shown in FIG. 3, simply depress the leaf spring 142 via a cut 112 provided on the first handle cover 11 corresponding to the leaf spring 142, so that the free end of the leaf spring 142 no longer contacts with the rear end surface 134 of the blade 13 to allow rotating of the blade 13 about the pivot pin 15 into the folded position.

According to the present invention, a safety for blade 2 is further provided at the first handle cover 11 close to the pivot pin 15. FIGS. 4 and 5 are enlarged exploded and assembled perspective views, respectively, of a part of the folding knife of the present invention to particularly show the structure of the safety for blade 2. As shown, the safety for blade 2 includes a slip switch 21, a push element 22, and an elastic element 23. The slip switch 21 of the safety for blade 2 is received in a recess 24 formed on the first handle cover 11 close to one side of the through hole 111. As can be seen from FIGS. 4, 6 and 7, there is a through hole 241 provided in the recess 24 for receiving the push element 22 and the elastic element 23 therein.

The recess 24 has an overall configuration matching with that of a top surface 211 of the slip switch 21 but is longer than the slip switch 21, so that the slip switch 21 could be moved in the recess 24 between a safety unlock and a safety lock position. The slip switch 21 also has a pair of side walls 212 downward extended from two sides of the top surface 211, such that when the slip switch 21 is received in the recess 24, the side walls 212 extend into two guide grooves 242 provided at two sides of the recess 24 for the slip switch 21 to move in a direction defined by the guide grooves 242. Lower edges of the side walls 212 form two hooking means that enable the whole slip switch 21 to slide within the recess 24 without separating therefrom. And, as can be seen from FIGS. 6 and 7, the top surface 211 of the slip switch 21 is provided at an underside with a downward projected protuberance 213. When the slip switch 21 is moved to the safety lock position, as shown in FIG. 7, the protuberance 213 extends down into the through hole 241 provided in the recess 24 to interfere with the push element 22 received in the through hole 241, forcing the push element 22 to lower relative to the first handle cover 11.

The push element 22 is movably received in the through hole 241 of the recess 24 and includes a stop collar 221. Please refer to FIGS. 1, 4, 6 and 7, a washer 19 is disposed between the first handle cover 11 and the blade 13 to align with the through holes 111 and 131. A hole 191 is provided on the washer 19 such that the hole 191 is diametrically smaller than the through hole 241 and is located below and aligned with the through hole 241. The stop collar 221 prevents the push element 22 from downward moving out of the through hole 241 and the hole 191. The elastic element 23 is disposed around a lower lock portion 222 of the push element 22 below the stop collar 221 and is therefore located in the through hole 241 between the stop collar 221 and the washer 19 to provide an upward restoring force against the push element 22. When the push element 22 is not interfered with by the downward projected protuberance 213 of the slip switch 21, the lower lock portion 222 of the push element 22 is pushed upward by the elastic element 23 to hide in the through hole 241 above the small hole 191 of the washer 19, as shown in FIG. 6.

An upper portion 224 of the push element 22 above the stop collar 221 is provided at a top with an inward curved surface 223. When the slip switch 21 is moved to the safety lock position, as shown in FIG. 7, the protuberance 213 interferes with the upper portion 224 of the push element 22 and engages a lower end with the inward curved surface 223, forcing the whole push element 22 to move downward in the through hole 241. At this point, the lower lock portion 222 of the push element 22 partially passes through the small hole 191 of the washer 19 to engage into a first locking hole 132 formed on the blade 13 close to one side of the through hole 131 or a second locking hole 133 formed on the blade 13 close to the other side of the through hole 131 to lock the blade 13 in place. FIGS. 6 and 7 show the manner of operating the safety for blade 2 of the present invention. Before turning the blade 13 into the extended position for use, first move the slip switch 21 to the safety unlock position in the recess 24 as shown in FIG. 6, allowing the elastic element 23 to push the push element 22 upward in the through hole 241. At this point, a user may use only one hand to operate the folding knife for the blade 13 to turn from the folded position in the handle to the extended position, as shown in FIG. 2. At this point, the first locking hole 132 at one side of the blade 13 is located directly below the lower lock portion 222 of the push element 22. The user needs only to move the slip switch 21 with one single finger to the safety lock position in the recess 24 as shown in FIG. 7, causing the protuberance 213 to interfere with and thereby depress the push element 22. At this point, the lower lock portion 222 of the push element 22 downward extends from the through hole 241 and through the hole 191 of the washer 19 to engage into the first locking hole 132 on the blade 13, restricting the blade 13 from moving for the blade 13 to be used in a safer manner.

When the user wants to close the blade 13 to the folded position in the handle of the folding knife, simply moves the slip switch 21 of the safety for blade 2 back to the safety unlock position as shown in FIG. 6, allowing the elastic element 23 to elastically push the push element 22 upward for the latter to locate in the through hole 241 again. At this point, the lower lock portion 222 of the push element 22 no longer engages with the first locking hole 132 on the blade 13 to lock the blade 13 in the extended position, and the user may depress the leaf spring 142 of the blade lock 14 to close the blade 13 to the folded position in the handle.

Similarly, when the blade 13 is the folded position as shown in FIG. 3, the second locking hole 133 on the other side of the blade 13 is located directly below the lower lock portion 222 of the push element 22. The user needs only to move the slip switch 21 to the safety lock position shown in FIG. 7 again to cause the lower lock portion 222 of the push element 22 to engage into the second locking hole 133 of the blade 13 At this point, the engagement of the lower lock portion 222 with the second locking hole 133 provides a further means to safely lock the blade 13 in the folded position. The blade 13 would not move out of the handle from the folded position even when the folding knife is carelessly dropped or subject to a considerably large impact.

Moreover, the recess 24 is provided at a bottom surface 243 with a round dent 244. And, the slip switch 21 is provided at the underside with a projected small dot 214 corresponding to the round dent 244. When the slip switch 21 is moved to the safety unlock position shown in FIG. 6, the small dot 214 engages into the round dent 244 to hold the slip switch 21 in the safety unlock position.

And, to facilitate operation of the slip switch 21 with only one single finger, the top surface 211 of the slip switch 21 is provided with a plurality of straight lines.

In brief, the safety for blade 2 for a folding knife according to the present invention provides a further protection to user by safely locking the blade in place to avoid the risk of unexpected movement of the blade, either in an extended or a folded position, while the folding knife may still be conveniently operated with only one single hand. The folding knife of the present invention is therefore superior to the conventional folding knives.

What is claimed is:

1. A folding knife, comprising:

a handle including a first handle cover having a recess formed therein, the recess having a through hole therein, said handle further including a second handle cover;

a blade having a rear end surface;

a washer disposed between said first handle cover and said blade, said washer having a hole disposed below the through hole, the hole in said washer being diametrically smaller than the through hole;

a blade lock, a portion of said blade lock forming a leaf spring having a free end;

a pivot pin extending through said first handle cover in a region of the recess, and extending through said second handle cover, said blade and said blade lock, said blade being pivotal about said pivot pin between a folded position in which said blade is disposed in said handle, and an extended position in which said blade is out of said handle; wherein the free end of said blade lock is inclined toward said blade such that when said blade is turned to the extended position the free end of said leaf spring abuts against the rear end surface of said blade to prevent said blade from moving and thereby locking said blade in said extended position, and when said leaf spring is depressed, said leaf spring disengages from the rear end surface of said blade thereby allowing said blade to turn to said folded position in said handle; and a safety for said blade that is provided on said handle, said safety including at least a finger-operable slip switch having a configuration matching the recess and being movably received within the recess, said slip switch being selectively movable within the recess between a safety unlock position and a safety lock position, said safety further including a push element received within the through hole, said push element having a stop collar, an upper portion above the stop collar, and a lower lock portion below the stop collar;

wherein when said slip switch is in said safety lock position, said slip switch interferes with said push element to cause said push element to move downward so that the lower lock portion engages into at least one locking hole provided at one side of said blade, so that said blade, either in said extended or said folded position, is restricted from moving;

wherein said stop collar cooperates with said washer to prevent said push element from moving downward out of the through hole when said slip switch interferes with said push element in the safety lock position; and wherein said upper portion of said push element is provided at a top with an inward curved surface, and said slip switch is provided at the underside of a top surface thereof with a downward projected protuberance, such that when said slip switch is moved to said safety lock position to interfere with said push element, said protuberance engages with said inward curved surface of said push element to depress said push element.

2. A folding knife, comprising:

a handle composed of a first handle cover having a recess formed therein, and a second handle cover;

a blade having a rear end surface;

a blade lock, a portion of said blade lock forming a leaf spring having a free end;

a pivot pin extending through said first handle cover in a region of the recess, and extending through said second handle cover, said blade and said blade lock, said blade being pivotal about said pivot pin between a folded position in which said blade is disposed in said handle, and an extended position in which said blade is out of said handle; wherein the free end of said blade lock is inclined toward said blade such that when said blade is turned to the extended position the free end of said leaf spring abuts against the rear end surface of said blade to prevent said blade from moving and thereby locking said blade in said extended position, and when said leaf spring is depressed, said leaf spring disengages from the rear end surface of said blade thereby allowing said blade to turn to said folded position in said handle; and a safety for said blade that is provided on said handle, said safety including at least a finger-operable slip switch having a configuration matching the recess and being movably received within the recess, said slip switch being selectively movable within the recess between a safety unlock position and a safety lock position, said safety further including a push element;

wherein when said slip switch is in said safety lock position, said slip switch interferes with said push element to cause said push element to move downward and engage into at least one locking hole provided at one side of said blade, so that said blade, either in said extended or said folded position, is restricted from moving, and wherein said recess is provided at a bottom surface thereof with a round dent and said slip switch is provided at an underside of a top surface thereof with a downward projecting dot corresponding to said round dent, such that when said slip switch is moved to said safety unlock position, said dot engages into said round dent to hold said slip switch in said safety unlock position.

3. A folding knife as claimed in claim 2, wherein said blade is provided at one side facing said first handle cover with a first and a second locking hole, and said push element of said safety, when being interfered with by said slip switch in said safety lock position, engages into said first and said second locking holes when said blade is in said extended position and said folded position, respectively.

4. A folding knife as claimed in claim 2, wherein said recess is provided with a through hole into which said push element is received.

5. A folding knife as claimed in claim 4, wherein said push element includes a stop collar, an upper portion above said stop collar, and a lower lock portion below said stop collar, said lower lock portion being a part of said push element that engages into said at least one locking hole on said blade; and said stop collar cooperating with a washer that is disposed between said first handle cover and said blade and has a hole below and diametrically smaller than the through hole of the recess to prevent said push element from downward moving out of the through hole of the recess when being interfered with by said slip switch in said safety lock position.

6. A folding knife as claimed in claim 5, wherein said safety further includes an elastic element disposed around said lower lock portion of said push element to provide a restoring force for moving said push element upward when said slip switch is moved to said safety unlock position without interfering with said push element.

7. A folding knife as claimed in claim 2, wherein said slip switch has a pair of side walls that extend downward from two sides of a top surface thereof, and wherein lower edges of said side walls form two hooking means, such that when said slip switch is received in said recess, said hooking means extend into two guide grooves provided at two sides of said recess for said slip switch to move in a direction defined by said guide grooves.

8. A folding knife as claimed in claim 7, wherein said hooking means engage with said guide grooves to retain said slip switch to said recess without separating therefrom.

9. A folding knife as claimed in claim 2, wherein said slip switch is provided at the top surface thereof with straight lines to facilitate convenient operation of said slip switch with only one finger.

* * * * *